US006416414B1

(12) United States Patent
Stadelmann

(10) Patent No.: US 6,416,414 B1
(45) Date of Patent: Jul. 9, 2002

(54) GAME SYSTEM, CORRESPONDING METHOD AND ADAPTED DEVICES

(75) Inventor: Anton Niklaus Stadelmann, Bolligen (CH)

(73) Assignee: Swisscom AG, Bern (CH)

( * ) Notice: Subject to any disclaimer, the term of this patent is extended or adjusted under 35 U.S.C. 154(b) by 0 days.

(21) Appl. No.: 09/622,365

(22) PCT Filed: Feb. 17, 1999

(86) PCT No.: PCT/CH99/00077

§ 371 (c)(1),
(2), (4) Date: Aug. 16, 2000

(87) PCT Pub. No.: WO99/42964

PCT Pub. Date: Aug. 26, 1999

(30) Foreign Application Priority Data

Feb. 19, 1998 (CH) ..... 402/98

(51) Int. Cl.[7] ..... A63F 9/24
(52) U.S. Cl. ..... 463/42; 463/43
(58) Field of Search ..... 463/6, 16, 17, 463/22, 25, 26, 29, 30, 39, 40, 41, 42, 43, 44

(56) References Cited

U.S. PATENT DOCUMENTS 5,759,101 A * 6/1998 Von Kohorn ..... 463/40
5,779,549 A * 7/1998 Walker et al. ..... 463/42
5,954,582 A * 9/1999 Zach ..... 463/25
5,999,808 A * 12/1999 LaDue ..... 455/412
6,118,986 A * 9/2000 Harris et al. ..... 455/90

FOREIGN PATENT DOCUMENTS

| | | |
|---|---|---|
| DE | 4136065 | 5/1993 |
| DE | 19502613 | 8/1996 |
| EP | 450520 | 10/1991 |
| EP | 689368 | 12/1995 |
| WO | WO 92/10806 | 6/1992 |
| WO | WO 94/11849 | 5/1994 |
| WO | WO 97/28636 | 8/1997 |

* cited by examiner

*Primary Examiner*—Joe H. Cheng
*Assistant Examiner*—Kim T. Nguyen
(74) *Attorney, Agent, or Firm*—Pillsbury Winthrop LLP

(57) ABSTRACT

Game system in which a plurality of participants transmit to at least one central play station (3) participant play data for taking part in at least one game (31, 32, 33) in special messages by means of mobile radio devices (2) through the mobile radio network (1). The central play station (3) carries out games according to predefined game rules and transmits central game data in special short messages through the mobile radio network (1) to the mobile radio devices (2) of the participants. The mobile radio devices (2) include a SIM card (21) for the game system, which has a memory, programmed means and a processor in order to show to a participant playing instructions and game results on a display (22) of a mobile radio device (2), and to convey the data to the central play station (3) by means of said special short messages, and to store a p repaid amount which can be used to pay for wagers and to which winnings can be booked.

15 Claims, 1 Drawing Sheet

GAME SYSTEM, CORRESPONDING METHOD AND ADAPTED DEVICES

BACKGROUND OF THE INVENTION

1. Field of the Invention

This invention relates to a game system. More specifically it relates to a game system in which a plurality of participants transmit to at least one central play station, through a telecommunications network, participant game data for taking part in at least one game, the central play station carrying out games according to predefined game rules and transmitting central game data to said participants.

2. Description of Related Art

In the known game systems, participants transmit their participant game data to a central play station in that they fill in lottery tickets or other betting slips, and these are received by corresponding, decentralized receiving points and are transmitted to a central play station through a communications network. The lottery numbers or the results of other bets are determined at such central play stations and are made public through various media, for example through television or newspapers. By showing a lottery ticket with winning numbers, or respectively a betting slip with the correct results, a participant can have paid out to him a winning sum, in relation to the amount wagered, by a receiving point or a central play station.

Other game systems are known from the Internet in which a participant transmits to a central play station participant game data through the Internet by means of a program on his personal computer, which central game station can carry out well-known casino games, such as blackjack or poker, and transmit corresponding central game data through the Internet to the program on the PC, which displays these data to the participant on the screen. To play for money, the participant has to have set up a game account at the central play station, to which wagered amounts and winning sums can be debited or credited.

Described in the patent application WO 97/28636 are a methods and corresponding means which make it possible for a player with a push button telephone, for example a mobile radio telephone, to take part in a gambling procedure via a telecommunications network. After entry of a PIN number (Personal Identification Number) and a bank account number, the participant according to WO 97/28636, can select a desired game, and enter betting numbers corresponding to the game, a confirmation of the keys pressed takes place acoustically over the telephone and/or optically on a selected teletext page. In the method according to WO 97/28636, playing fees and playing winnings can be booked, for example, to an indicated bank account.

Described in the patent application DE 195 02 613 A1 is a playing system in which a plurality of playing devices, in particular also mobile radio telephones, are connectable to a central computer via a remote data transmission. According to DE 195 02 613, allocated to the central computer is a random generator which determines winning symbol combination which are displayed on the playing devices. To take part in a game, the playing devices, according to DE 195 02 613 A1, comprise a coupling device with a special registration number, for example a card reader for receiving a personal identification card with a PIN number stored thereon, it being possible for the registration number to form the winning number at the same time; for example the end digits of the PIN number stored on the identification card can be used to determine a possible winning. According to DE 195 02 613, on-line playing fees and playing winnings can also be booked via a card reader, if a value card is inserted into the card reader.

SUMMARY OF THE INVENTION

It is the object of this invention to propose a new game system in which in particular interested participants are independent of special receiving points, and are not bound to a place that has personal computers linked to the Internet.

According to the present invention these objects are attained in particular through the elements of the characterizing part of the independent claims. Further preferred embodiments follow moreover from the dependent claims and from the description.

In particular these objects are attained through the invention in that the game data exchanged between the participants and the central play station is transmitted in special short messages by a plurality of mobile radio devices through the mobile radio network to the central play station, or respectively from the central play station through the mobile radio network to the mobile radio devices of the participants.

According to the invention, the central play station comprises a server and means of receiving participant game data from registered participants in special short messages from a plurality of mobile radio devices through a mobile radio network, means to determine central game data according to predefined game rules, and means to transmit the determined central game data in special short messages through the mobile radio network to the mobile radio devices of the participants.

According to the invention, the mobile radio devices of the participates have a SIM card, which contains means according to the invention to display to the participant playing instructions and game results on a display unit of the mobile radio device, to receive participant game data, entered through input means of the mobile radio device, and to transmit said data to the central play station by means of special short messages.

The SIM card preferably has, moreover, means to store a prepaid amount, which can be used to pay for wagers, and also to book winnings. Such a SIM card has the advantage that a participant can be provided thereby in an efficient way with personal and customer-specific means to take part in games. Moreover through the SIM card the participant can be identified by the central play station, for example by means of a unique participant tag, an IMSI (international mobile subscriber identifier) stored on the SIM card.

According to the present invention, the central play station also comprises means to book wagered amounts transmitted by participants in participant game data to game accounts of the participants, which are preferably stored in a database accessible to the central play station, and means to determine winning quotas of played games, to distribute winning sums, and to book them to the corresponding game accounts.

The participants are preferably identified and their identity authenticated by the central play station. It can be ensured thereby that wagered amounts or winning sums, are debited, or respectively credited, to the correct participant.

In the present invention, to ensure the authenticity of game data and above all also the authenticity of identity of the respective participant, the game data exchanged through the mobile radio network between the mobile radio devices and the central play station are preferably transmitted with the aid of security services, such as, for example, TTP (trusted third party) or a corresponding encryption method.

An embodiment of the present invention will be described in the following using an example. The example embodiment is illustrated by the following attached figure:

DETAILED DESCRIPTION OF THE EMBODIMENTS

Figure 1:
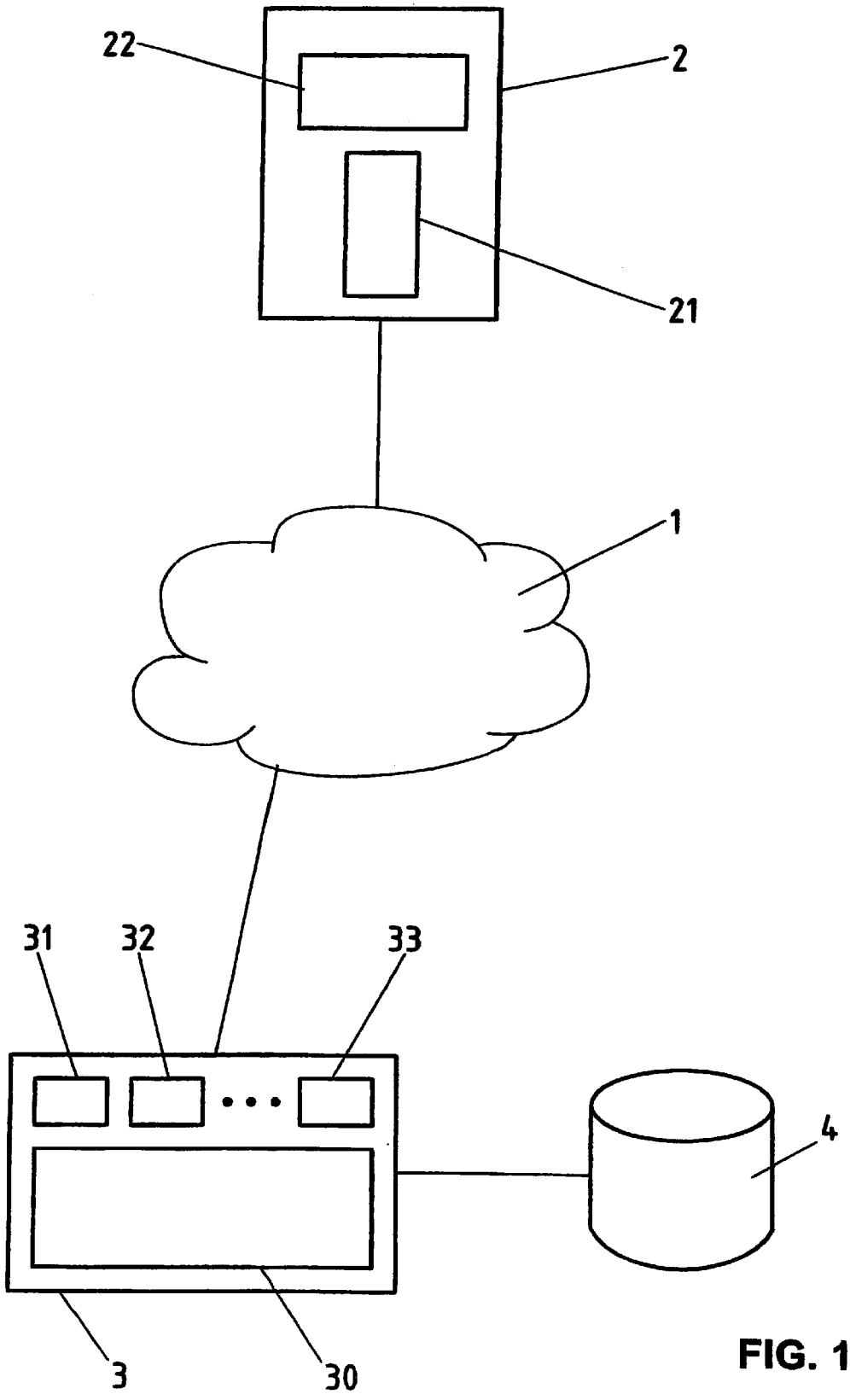
FIG. 1 shows an overall diagram with a mobile radio network and mobile radio devices connected thereto and a central play station with access to a database.

A participant, who would like to take part in games 31, 32, 33, can open a game account with the operator of a central game station 3, into which account he can pay a desired amount in a specific currency. In a variant, the currency can also be as desired, and will be converted into a unified currency, for example SDR, by the central play station 3 by means of a table with rates of exchange stored in a database 4. The opening of the account takes place either directly at a sales point of the operator, or, in a variant, by means of special administrative services, directly from the mobile radio device 2, for example a mobile telephone, with the aid of security services such as, for example, TTP (trusted third party), PTP (point-to-point) methods or another encryption method. The payment of the monetary amount into the game account can take place by means of cash deposit at a sales point of the operator, a monetary transfer can be made from another account, or a payment order made, or purchased phone cards can be used which can be transferred to the game account by validation services at the central play station 3.

In a variant, a participant can have a prepaid amount stored by the operator of the central play station 3 on his SIM card 21. If the participant registers for games 31, 32, 33 by means of special services at the central play station 3, a prepaid amount stored on the SIM card 21 can be transferred thereby to the central play station 3, in that by means of special messages through the mobile radio network 1, for example a GSM network, it is transferred to the central play station, validated there, stored on the game account of the participant, and subtracted from the SIM card. In another variant, a prepaid amount stored on the SIM card 21 is first transferred to the central play station 3, and validated there, if there is participation in a game 31, 32, 33 or if the participant wishes to transfer, with a further special service, a certain portion of the prepaid amount stored on the SIM card 21 to his game account. The participant can be identified by the central play station 3, for example by means of a unique participant tag, an IMSI (identity mobile subscriber identifier), stored on the SIM card.

Special services are carried out in this embodiment example preferably according to the SICAP method, which is described in EP 0 689 368 B1, among other sources, or according to a similar method.

If a participant wishes to take part in a game 31, 32, 33, he can enter a command for game registration on his mobile radio device 2, for example by means of a predefined key of the mobile radio device 2, a predefined number, which can be entered using the keyboard of the mobile radio device 2, or by selecting the corresponding command from a list or a menu shown on the display 22. The command is received by a program on the SIM card 21 of his mobile radio device 2, which prepares a special short message with the game registration and transmits this message through the mobile radio network 1 to the central play station 3.

At the central play station 3 the special short message is received, its game registration is taken, and the participant is registered in a table of the database 4, in which all the registered players are entered. After completed registration, the balance of the participant's game account is transmitted to him by means of special services, and is shown on the display 22 of his mobile radio device 2, and is stored on his SIM card 21. In a variant, in which a prepaid amount stored on the SIM card 21 is not transmitted to the central play station 3 during the registration, the participant can be shown this amount as the amount available for playing.

In a variant, the participant indicates already during the registration in which games 31, 32, 33 he wishes to take part, for example a number lottery or betting on a horse race, and the respective game is likewise entered together with the participant in the table of the registered players by the central play station 3. In another variant, the participant does not limit himself, and thereby registers himself as a potential player for all available games 31, 32, 33. Depending upon the range of games offered, it can also be that a participant has to register himself for a very specific game 31, 32, 33 from among many possible games 31, 32, 33, for example for German football among the sports matches.

Upon beginning a game 31, 32, 33, which, depending upon the type of game 31, 32, 33 and the embodiment variant, can take place immediately after registration of a participant for the respective game 31, 32, 33, after registration of a predefined number of participants for the respective game 31, 32, 33, or at a predetermined point in time, the central play station 3 transmits by means of a special short message central game data through the mobile radio network 1 to all registered players with the request to enter and to transmit all participant game data required for the respective game 31, 32, 33. Required in the case of a game of chance, for example, is a bet, for example one or more lottery numbers, the winner of a horse race or the winner of a ski race, and an amount placed as a bet, which can be freely selected or can be limited to pre-given amounts. In the case of a card game, such as, for example, blackjack, the player is allotted a playing card, in this example, and this card is represented to him symbolically, and an amount to be placed as a bet is requested from him, as well as playing instructions, saying for example to give a further card or that he has enough cards. This is done preferably in such a way that the central playing data are handled with special services by means of a program stored on the SIM card 21 to carry out the method of execution already mentioned above, the information and instructions contained in the central game data being shown to the player by means of the display 22 of the mobile radio device 2. According to the instructions of the central play station 3, the player can enter his participant game data by means of a keyboard of the mobile radio device 2, or in another variant can use special keys to select values and instructions from a menu and/or list shown on the display 22. The program mentioned above on the SIM card 21 receives the entered information, and transmits it as participant game data in special short messages through the mobile radio network 1 to the central play station 3 through the mobile radio network 1 as the reply to the request to play.

The wagered amount entered by the participant is preferably compared each time with the balance of the game account stored on the SIM card 21 by the program on the SIM card 21, or in a variant with the prepaid amount stored on the SIM card 21, in order to ensure that it is covered. If the amount wagered is not covered, this is displayed to the participant, whereby the participant can then enter a smaller amount or stop the game 31, 32, 33. This has the advantage that uncovered bets do not have to be transmitted through the mobile radio network 1, and the central play station 3 is relieved of the burden. If the amount wagered is covered, it is deducted by the program on the SIM card 21 from the balance of the game account stored on the SIM card 21, or in a variant from the prepaid amount stored on the SIM card 21, if the bet has been transmitted successfully, and, depending upon the game 31, 32, 33, within the regular playing time. The reception and acceptance of the bet is preferably confirmed to the participant by the central play station 3 by means of special short messages, and the amount placed, the bet and, if applicable, the new balance of the game account of the participant are transmitted, for example.

The central play station 3 preferably comprises a server with a central service unit 30 for handling special short messages, which is designed in such a way that it can carry out special services according to the above-mentioned method which are ordered by participants in the mobile radio network 1, for example a mobile radio network 1 according to the GSM standard, in SMS short messages, for example, or in USSD (unstructured supplementary service data). For example, the games 31, 32, 33 available in the central play station 3 are special services which can be carried out by the central service unit 30.

The participant game data transmitted in the special short messages as the reply to the request to play, as mentioned above, are received by the central play station 3 and are correspondingly further handled in the respective game 31, 32, 33. For example, the wagered amount placed by the participant in a game of chance is stored, together with the bet made, in a table for the respective participant and the respective game stored in the database 4, and the wagered amount is debited to the game account of the participant. Depending upon the type of game 31, 32, 33, the wagered amounts can also be accumulated to determine moreover a total winning sum. As already mentioned above, the acceptance of a bet is preferably confirmed to the participant by the central play is station 3.

Depending upon the playing rules of the game 31, 32, 33, participant game data are received only during a regular playing time determined in advance so that, for example, bets received after expiration of the playing time are not accepted by the central play station 3, and a message to this effect is sent to the participant. Afterwards the game results are determined by the central playing station according to the playing rules of the game 31, 32, 33 and using the received participant playing data. For example, in the case of a wager, the bets received are compared with the betting results, i.e. the result of the subject being bet upon, for example the winning numbers pulled in a lottery, which in a variant can also be determined by the central playing station, the winner of a horse race or the winner of a football game, and the winning quotas and winning sums are determined on the basis of the received wagered amounts. The winners are determined, and the winnings owed them are added to their game accounts, or, in a variant, added to the prepaid amount on their SIM card 21. The winnings and the new balance of their game account are transmitted to the winning participants in special short messages, and are displayed on the display 22 of their mobile radio device 2, and the new balance of their game account is stored on their SIM card 21. The game result and the winning quotas are preferably transmitted and displayed to all the participating players in special short messages.

It should be mentioned that the game data, especially if it contains monetary amounts, are transmitted with the aid of security services such as, for example, TTP (trusted third party) or a corresponding encryption method in order to ensure the confidentiality, the authenticity, the indisputableness of origin and the integrity of the game data, and above all the authenticity of identity of the participant concerned.

In particular for games 31, 32, 33 which have a complex course as gamed of chance, the game steps executed in such a game 31, 32, 33 are stored for the participants by the central play station 3 in tables of the database 4 so that the current game status for each participant in a respective game 31, 32, 33 can be determined at any point in time during a game. For example, in a game of blackjack, the cards already seen by a player, the wagered amounts placed in each case, as well as the player's last instruction are stored so that it can be determined in the central play station 3 through respective game 31, 32, 33 whether the respective player possibly wants to take further cards, whether he already has enough cards and the opponent can make a move, whether a new game series begins or whether new cards have to be shuffled. Among other things, this definitely makes it possible for a participant to take part in several games 31, 32, 33 at the same time. It is of course clear that, for this purpose, the respective game 31, 32, 33 for which instructions are shown to the participant, for example, is clearly identified and displayed to the participant in order to avoid mix-ups.

Provisions evidently have to be made as to how to proceed in carrying out all games 31, 32, 33 if a participating player does not transmit expected participant game data within a pre-given time period or is eliminated from the game 31, 32, 33 by turning off his mobile radio device 2 or by breaking off the game 31, 32, 33. In such cases his wagered amount for unfinished games for which he still has not completed the transmission of the expected participant game data can simply remain in the winning sum to be distributed, for example, and the information stored in the tables of the database 4 relating to the participant can be deleted. However, for games 31, 32, 33 in which he has stopped participating before the game results were determined, but for which he has transmitted all expected participant game data, possible winnings can be booked to his game account, and the related information stored in tables of the database 4 relating to the participant can be kept until the end of the respective game 31, 32, 33, and deleted afterwards. This has the advantage that games of chance can also be carried out, for example, in which the placing of bets can be permitted over a longer period, i.e. a period of hours or even days. Upon breaking off the game, turning off the mobile radio device 2 and after a pre-determined period of time without transmission of participant game data, the participant is deleted in the table of registered players stored in the database 4.

Besides requests to transmit participant game data or information concerning game results and winnings, the central play station 3 can also transmit auxiliary information, game rules, conditions for participation, results of previous games 31, 32, 33 and the like by means of special short messages through the mobile radio network 1 to the participants. For this purpose, the participant can ask for specific information by selecting it from a list transmitted by the central play station 3 or stored on the SIM card 21, which is shown on the display 22. In a variant, by means of a predefined key the participant can also request context-specific help information, which, for example, can be determined by the central play station 3 on the basis of the game 31, 32, 33 in progress or the game situation, and can be transmitted to the participant.

For marketing this game system, in particular for more complex games 31, 32, 33, it can definitely be useful to produce SIM cards which are specially designed for this purpose and which have stored prepaid monetary amounts that can be reloaded. In a variant, game programs can be loaded on the SIM card 21 by means of special short messages, for example by the central play station 3 through the mobile radio network 1.

It should also be mentioned here that the mobile radio devices 2 comprise, in addition to mobile telephones, also other devices, for example laptop or palmtop computers which have an identification chipcard, i.e. a SIM card 21, and which can receive and transmit special short messages through the mobile radio network 1, for example a GSM network, and can carry out corresponding special services, according to the above-mentioned SICAP method, for example.

What is claimed is:

1. A game system in which a plurality of participants transmit to at least one central play station through a telecommunications network, participant game data for taking part in at least one game, the central play station carrying out games according to predefined game rules and transmitting central game data to said participants, the game data exchanged between participants and the central play station being transmitted in special short messages by a plurality of mobile radio devices through a mobile radio network to the central play station or respectively by said central play station through said mobile radio network to said mobile radio devices of said participants, wherein the mobile radio devices comprise a SIM card, which has memory, programmed means and a processor, the programmed means containing a program for executing the following functions:

displaying playing instruction and game results on a display of the mobile radio device, receiving participant game data entered through input means of the mobile radio device, and transmitting the entered participant game data to the central play station by means of said special short messages.

2. The game system according to claim 1, wherein the central play station includes:

a receiver for receiving bets transmitted by participants;

a comparator for comparing the received bets with betting results and determining winners and winning sums; and a transmitter for transmitting game results to the participants.

3. The game system according to claim 1, wherein the central play station includes at least one server and has access to at least one database in which game accounts of participants are stored to which wagered amounts and winning sums are booked.

4. The game system according to claim 1, wherein said SIM card has stored an amount which is used to pay wagered amounts.

5. The game system according to claim 4, wherein the said central play station books winnings to said SIM card.

6. The game system according to claim 1, wherein the central play station identifies said participant by means of a participant tag stored on said SIM card.

7. The game system according to claim 1, wherein the central play station has access to at least one database in which the central play station stores, for at least certain games, the playing steps carried out for said participants participating therein.

8. The game system according to claim 1, wherein said special short messages are transmitted as short message service short messages or as unstructured supplementary service data.

9. A method for carry out games in a central play station comprising:

transmitting participant game data in special short messages by a plurality of mobile radio devices through a mobile radio network to participants, determining central game data according to predefined game rules, and transmitting determined central game data in special short messages through said mobile radio network to the mobile radio devices of the participants, wherein a SIM card is inserted into the mobile radio devices in each case, which SIM card has memory, programmed means and a processor, the programmed means containing a program through which the following steps are executed:

displaying playing instructions and game results on a display of the mobile radio device;

receiving participant game data entered through input means of the mobile radio device; and transmitting the entered participant game data to the central play station by means of said special short messages.

10. The method according to claim 9, wherein the participant game data includes wagered amounts, and further comprises:

identifying and authenticating the participants;

booking received wagered amounts in a database;

determining winning quotas; and distributing and booking winning sums.

11. The method according to claim 9, further comprising:

receiving special short messages with game registrations from interested participants;

transmitting special short messages to registered participants with a request to begin play and for time-limited transmission of participant game data; and storing the received participant game data.

12. The method according to claim 9, further comprising:

debiting to a game account or to a SIM card of a registered participant a particular monetary amount for the transmission of short messages.

13. The method according to claim 9, further comprising:

receiving a command for game registration, which has been entered by a participant through input means of said mobile radio device;

preparing a special short message with the game registration and transmission thereof to said central play station; and receiving special short messages from said central play station with a request to begin play and for time-limited transmission of participant game data, and transmission of the request to the display of said mobile radio device.

14. The method according to claim 9, further comprising;

booking a wagered amount transmitted to said central play station against a prepaid stored amount.

15. The method according to claim 9, further comprising:

booking a winning sum transmitted by said central playstation.

* * * * *